United States Patent [19]

Oishi et al.

[11] Patent Number: 4,911,957

[45] Date of Patent: Mar. 27, 1990

[54] METHOD OF FORMING FERRITE FILM ON PARTICLES OR FIBERS

[75] Inventors: Masao Oishi, Neyagawa; Takao Saito, Toyonaka; Katsukiyo Ishikawa, Kyoto, all of Japan

[73] Assignee: Nippon Paint Co., Ltd., Osaka, Japan

[21] Appl. No.: 247,609

[22] Filed: Sep. 22, 1988

Related U.S. Application Data

[63] Continuation-in-part of Ser. No. 94,403, Sep. 8, 1987, abandoned.

[30] Foreign Application Priority Data

Sep. 5, 1986 [JP] Japan ..... 61-210364

[51] Int. Cl.[4] ..... B05D 1/18

[52] U.S. Cl. ..... 427/443.1; 427/132; 427/304; 427/126.6; 427/217; 427/222

[58] Field of Search ..... 427/443.1, 132, 304, 427/126.6, 217, 222

[56] References Cited

U.S. PATENT DOCUMENTS

| | | | |
|---|---|---|---|
| 4,069,164 | 1/1978 | Dezawa | 427/107 |
| 4,113,658 | 9/1978 | Genus | 427/404 |
| 4,151,311 | 4/1979 | Feldstein | 427/304 |
| 4,239,637 | 12/1980 | Naruse | 427/132 |
| 4,265,942 | 5/1981 | Feldstein | 427/304 |
| 4,325,983 | 4/1982 | Feldstein | 427/304 |
| 4,837,046 | 6/1989 | Oishi | 427/443.1 |

FOREIGN PATENT DOCUMENTS

| | | | |
|---|---|---|---|
| 1189228 | 6/1985 | Canada | 427/304 |
| 111929 | 7/1982 | Japan . | |

*Primary Examiner*—Shrive Beck
*Assistant Examiner*—Vi Duong Dang
*Attorney, Agent, or Firm*—Wenderoth, Lind & Ponack

[57] ABSTRACT

Disclosed is a method of forming a ferrite film on particulate and/or fibrous substrate by adding an oxidizer solution and a ferrous ion solution to a deoxidized solution containing particulate and/or fibrous substrates to form a thin ferrite film on the particulate and/or fibrous substrates, wherein an addition amount of the ferrous ion solution is controlled such that an oxidation-reduction potential of the deoxidized solution keeps approximately a center point between the oxidation side and the reduction side, when a pH value of the dioxidized solution is adjusted to a constant value between pH 6 and 10.

8 Claims, 5 Drawing Sheets

SUBSTRATE
$Fe^{2+}$
$MOH^{(n-1)+}$
$FeOH^{+}$
$M^{n+}$
$FeOH^{+}$
$Fe^{2+}$
OXIDATION $Fe^{2+}$
$MOH^{(n-1)+}$
$FeOH^{2+}$
$M^{n+}$
$FeOH^{2+}-FeOH^{+}$
$Fe^{2+}-MOH^{(n-1)+}$
FERRITE FORMING REACTION

FERRITE LAYER
$Fe^{2+}$
$M^{n+}$
$Fe^{3+}$
$M^{n+}$
$Fe^{3+}$
$Fe^{2+}$
$Fe^{2+}$
$M^{n+}$

METHOD OF FORMING FERRITE FILM ON PARTICLES OR FIBERS

CROSS-REFERENCE TO RELATED APPLICATION

This application is a continuation-in-part of copending application Ser. No. 94,403, filed on Sept. 8, 1987, now abandoned.

FIELD OF THE INVENTION

The present invention relates to a method of forming a ferrite film on particules or fibers.

BACKGROUND OF THE INVENTION

Various methods of forming ferrite film on a substrate surface have been proposed, which include an application method using a mixture composed of ferrite particles and a binder, and a physical deposition method such as sputtering process. However, a method of growing ferrite crystals on a substrate (hereinafter called "electroless ferrite plating method") has been recently proposed (Japanese Laid-open Patent Application No. 111929/1984). This method is noticeable because an excellent ferrite film with high crystallinity can be formed.

According to the method, as shown in FIG. 9, respective species of ions are absorbed on a substrate as shown in FIG. 9(*a*) by contacting the substrate with a solution containing ferrous ions ($Fe^{2+}$ or $FeOH^{+}$) and other metal ions ($M^{n+}$ and $MOH^{n-1+}$). Although FIG. 9(*a*) illustrates that individual ions are bonded to oxygen atoms on the substrate, the ions actually are considered to deposit on the substrate by various reasons such as binding with oxygen or absorption. Afterwards, the ions formed on the substrate are oxidized as shown in FIG. 9(*b*). The oxidized ions react to form a ferrite film as illustrated in FIG. 9(*c*). Subsequently, the former condition shown in FIG. 9(*a*) resumes. Ferrite films successively grow with the recurrence of above mentioned steps.

The electroless ferrite plating method is highly rated as an excellent technique to form a ferrite film on a plate-like substance such as a magnetic tape or disk.

However, every application of ferrite films formed by the electroless ferrite plating method is exclusively associated with a plate-like substance, and particles or fibrous substances has never been considered as a substrate for the electroless ferrite plating method. In the electroless ferrite plating method, it is believed that the ferrite forming reaction not only occurs on particulate or fibrous substrates as shown in FIG. 9, but also occurs in the solution to by-produce ferrite particles. Thus, it is difficult to separate the resultant product from the by-producted ferrite particles. Even when forming a ferrite film on a plate-like substance, inhibiting the accompanying generation of particle ferrite is a vital requirement concerning quality and other aspects. Due to the above reasons, application of the electroless ferrite plating method to particulate substrates has been considered to be impossible.

SUMMARY OF THE INVENTION

Surprisingly, it has been found that a ferrite film can be selectively formed on the surface or particles or fibers when the electroless ferrite plating method is employed with controlling a concentration of the ferrous ions and a pH of the deionized solution.

The present invention provides a method of forming a ferrite film on particulate and/or fibrous substrate by adding an oxidizer solution and a ferrous ion solution to a deoxidized solution containing particulate and/or fibrous substrates to form a thin ferrite film on the particulate and/or fibrous substrates, wherein an addition amount of the ferrous ion solution is controlled such that an oxidation-reduction potential of the deoxidized solution keeps approximately a center point between the oxidation side and the reduction side, when a pH value of the dioxidized solution is adjusted to a constant value between pH 6 and 10.

It has not been known that the ferrite film is selectively formed on the particulate or fibrous substrate by controlling the conditions of the electroless ferrite plating method. It is believed that the reason why the ferrite film is selectively formed on particle surface may be attributable to the properties of particle surface, especially the high surface energy.

DETAILED DESCRIPTION OF THE INVENTION

The particles having a means particle-diameter of less than 100μ, preferably 0.3 to 50μ are most suitable to the present invention. Ferrite film formation is slow with the particles having a mean diameter of more than 100μ, resulting in increased by-products. In the present invention, the term "particles" means spheric, irregular or tabular particles. The method of the present invention is appliable to a fibrous substrate, because the fibrous substrate also has a large surface area, similar to the paticular substrate. Such selective ferrite film formation was experimentally evidenced. In the case of fibrous substrate, the use of substrate with a diameter of less than 100μ is preferable.

The particulate or fibrous substrates (hereinafter generally called the particulate substrate) may be composed of any material; e.g., resins, metals, metal oxides, organic pigments, celluloses, synthetic high polymer materials, ceramics and the like. Especially, resins and those having organic surface are suitable. According the theory of ferrite formation illustrated in the above mentioned FIG. 9, the ferrous ions are considered to be primarily adsorbed on oxygen atoms existing on the particle surface. Therefore, materials such as resins, metal oxides and ceramics are considered to have oxygen atoms existing on the surface, and advantageous in the respect. For example, oxygen atoms derived from silanol groups are considered to be present on the surface of glass or the like. Actually, absorption reaction may occur not only by oxygen atoms but due to the unique surface properties of the surface. This feature may be attributable to the shape of particulate substrate surface, contaminations on the particle surface or other reasons.

Forming a ferrite film is performed in an aqueous solution having particulate substrates. The ferrous ions are supplied to the deoxidized solution in the form of the ferrous ion solution containing ferrous chloride, sulfate or acetate. When the ferrous ion solution contains ferrous ions alone as metal ions, an obtained film is made of magnetite $Fe_3O_4$ which is spinel ferrite containing iron along as metal atoms. Other transition metal ions $M^{n+}$ other than the ferrous ions may be contained in the ferrous ion solution. Other metal ion species include zinc ions, cobalt ions, nickel ions, manganese ions, copper ions, vanadium ions, antimony ions, lithium ions, molybdenum ions, titanium ions, rubidium ions, aluminum ions, silicon ions, chromium ions, tin ions, calcium ions, cadmium ions and indium ions. When M represents cobalt, cobalt ferrite ($CoxFe_3xO_4$) is obtained, and when M represents nickel, nickel ferrite ($NixFe_{3-x}O_4$) is obtained. When M comprises more than one metal ion species, mixed crystal ferrite is obtained. The above metal species, other than ferrous ions may be mixed into the aqueous solution in the form of water-soluble salt.

In the present invention, the forming of ferrite film is initiated by adding the oxidizer solution and the ferrous ion solution to the deoxidized aqueous solution containing the particulate substrates. Examples of the oxidizers used in the invention are nitrite salt, nitrate salt, hydrogen peroxide, organic peroxide, perchlorate and water containing dissolved oxygen. If the oxidizer has strong oxidizing power, an amount of by-products increases and the purity of ferrite decreases. If it has weak oxidizing power, the rate of the ferrite forming reaction is low or even no reaction is raised. Preferred oxidizer is nitrite.

According to the present invention, the ferrous ion solution and the oxidizer solution are added dropwise to the deoxidized solution containing the fiberous substrates with controlling the oxidition-reduction potential of $Fe^{2+}/Fe^{3+}$. For example, when an addition amount of the oxidizer solution is kept constant, if an increased amount of the ferrous ion solution is added, then the oxidation-redution potential becomes low, thus increasing an $Fe^{2+}$ concentration. In this case, a concentration of free $Fe^{2+}$ ions becomes high and therefore by-products increase. If the ferrous ion solution adds in a small amount, the $Fe^{2+}$ ions are almost consumed and the oxidation-reduction potential becomes high, thus increasing the concentration of the oxidizer. In this case, the $Fe^{2+}$ ions are rapidly oxidized to $Fe^{3+}$ ions and the purity of ferrite becomes low. It, therefore, is important that the amount of the ferrous ion solution is controlled such that the oxidation-reduction potential of the deoxidized solution keeps approximately a center point between the oxidation side and the reduction side.

The center point of the oxidation-reduction potential is generally determined by the relation of potential with $Fe^{2+}$ concentration, and the following method is convenient. When the reaction was continued, a reaction (suspension) solution is sampled and put on a filter paper. If the color of the stain on the filter paper is changed to brown, it shown that $Fe^{2+}$ ions are existent. If no color change occurs, it shows no $Fe^{2+}$ ions. Then, the width of the oxidation-reduction potential is determined as described above and the potential is controlled to an approximately center point.

The oxidation-reduction potential is generally varied depending upon pH value, so that controlling the potential is required to be conducted with keeping the pH value constant. The pH value is controlled by adding an alkaline solution such as an ammonia solution, preferably within ±0.2. The pH value of the aqueous solution is arbitrarily selected between 6 to 10. To obtain stable pH value, a buffer solution or salt having buffering effect such as sodium acetate may be added.

The temperature conditions to perform the reaction of the invention is lower than the boiling point of the aqueous solution, and a temperature within the range of 60° to 90° C. is preferable. The reaction is performed under a substantially deoxidized atmosphere. An atmosphere containing large ratio of oxygen is disadvantageous because it promotes unnecessary oxidizing reaction. More specifically, the reaction of the invention should be promoted under a nitrogenous atmosphere. For the same reason, the aqueous solution is deoxidized to prepare the deoxidized aqueous solution.

The particulate substrate used for the invention can be used without treatment, or with pre-treatments such as plasma treatment, alkaline treatment, acid treatment or other physical treatments which are performed for plate-like materials including a magnetic disk. Performing these treatments improves wettability, thus uniform film is obtainable.

The technical effect of the present invention is achieved by the method described below. First, particulate substrate is suspended in deoxidized water. At the same time, additives such as a surfactant may be added, if necessary, so as to improve wettability of the particulate substrate with water. A pH buffer is mixed into the solution to maintain a desired pH range, thereinto ferrous ion solution is added dropwise. Other metal ions may be contained in the ferrous ion solution, according to the requirement. The reaction is allowed to proceed by adding an oxidizing solution dropwise together with the addition of the ferrous ion solution to the aqueous solution as described above. Obtained particulate substrate capsuled with ferrite film is separated from the aqueous solution by filtration and then dried to obtain a desired product.

In the process of the invention, as mentioned above, the employing quite simple a procedure, the surface of particulate substrate is selectively capsuled with a ferrite film, thus novel particulate substrate can be obtained.

According to the present invention, the obtained ferrite film is uniform and few by-products are produced. The chemical composition of the ferrite is not changed between the begining and the end.

The ferrite film coated particulate substrate obtained by the invention is applicable to various purposes. For example, individual toner or carrier particles for electrophotography can be capsuled with a ferrite film, enabling the prevention of toner flying around within a copier or the use of resinous material with a low softening point. Additionally, the particles capsuled with a ferrite film may be applied to a display material (e.g. magnetic display) or recording material (e.g. magnetography). Moreover, other particulate substrate such as pigment can be capsuled with a ferrite film and mixed in paint, ink, a molded resin product or the like. Pigment or other material may be capsuled with a ferrite film to produce pigment with a color different from the original one and to improve properties of the pigment. Particulate drugs, especially pharmaceuticals, ensures excellent effect if coated with a ferrite film and concentrated with a magnet on the affected part of patient.

EXAMPLES

The present invention is described more specifically by referring to the preferred examples, which, however, are not to be construed as limiting the scope of the invention to their details.

EXAMPLE 1

0.9 liter of deionized water was poured into a reactor vessel.

Hundred gram of deionized water where ten g titanium dioxide having been dispersed with was added into the reactor vessel, whereby oxygen in the solution was removed with $N_2$ gas. After thorough deoxidization, the pH value was adjusted to 6.9 with ammonia water. The temperature in the reactor vessel was maintained at 70° C. A solution prepared by dissolving 20 g of sodium nitrite in one l of deionized water which had been deoxidized and a ferrous ion solution of 100 cc prepared by adding 10 g of $FeCl_2$ into deoxidized water were added dropwise to the reactor vessel at a rate of five cc/min. By separately determining, the oxidation-reduction potential of this solution was set to −470 mV and the addtion amount of the ferrous ion solution was controlled by addtion rate. The pH value was maintained constant during this course. After approx. 20 minutes had passed, particles of titanium oxide were encapsulated with magnetite. Virtually no magnetite particles as by-products were formed. After ten minutes of aging, the particles were separated by filtration and rinsed with water. The color of the produced magnetite plated titanium oxide was gray.

According to the method, a product with yellowish color can be obtained by adding metal ions other than of iron, such as Zn or Ni. This type of product is applicable to various purposes such as paints or cosmetics.

EXAMPLE 2

0.9 l of deionized water was poured into a reactor vessel.

Hundred g of deionized water where ten g of six m polystyrene particles (Fine Pearl 300F manufactured by Sumitomo Chemical Co., Ltd.) having been dispersed was supplied to the reactor vessel, whereby oxygen in the solution was removed with $N_2$ gas. After thorough deoxidization, the pH value was adjusted to 6.9 by 0.1 N-NaOH. Then, the reactor vessel was heated to 70° C., thereby the ferrous ion solution as prepared in Example 1 and a solution prepared by dissolving 20 g of sodium nitrite in one l of deionized water already deoxidized was supplied to the reactor vessel at a rate of five cc/min. A pH value was maintained constant during this course and an oxidation-reduction potential was also kept −470 mV as in Example 1. After approx. 20 minutes had passed, polystyrene particles were encapsulated with magnetite. Virtually no magnetite particles as by-products were formed. The magnetite plated polystyrene particles were filtered out and rinsed with water. The color of obtained magnetite capsuled polystyrene particles was black.

The configuration of individual particle is illustrated by electron-microscopic photographs.

Figure 1:
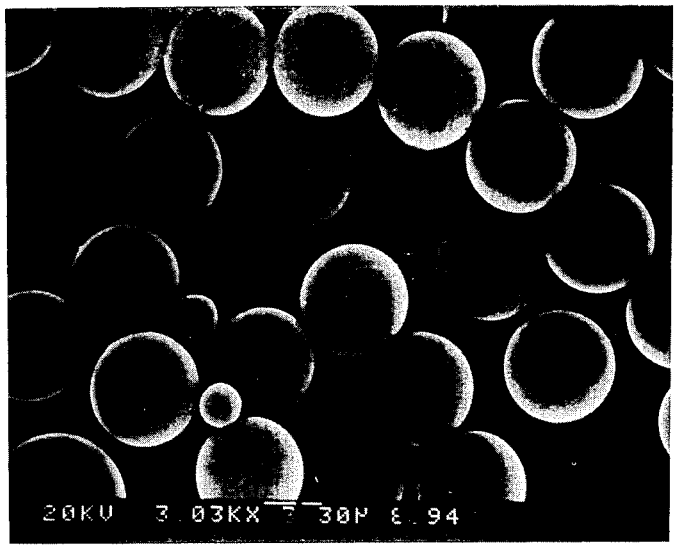
FIG. 1 is a photograph (magnification, 3030) showing the structure of polystyrene particles used as material in example 2.
Figure 2:
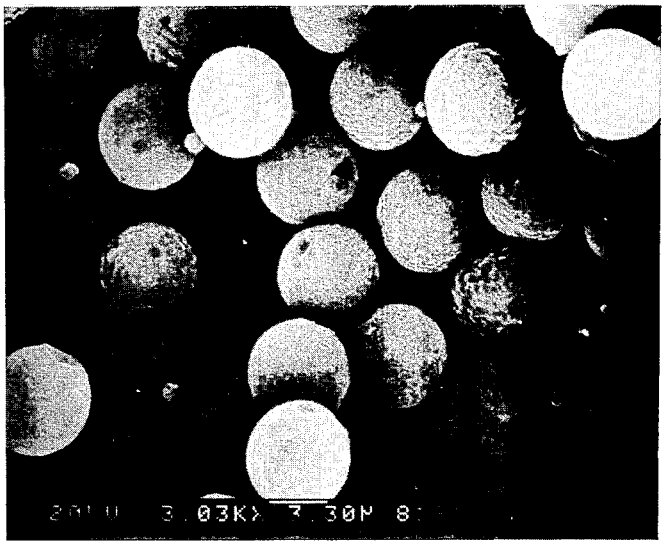
FIG. 2 is a photograph (magnification, 3030) showing the structure of polystyrene particles, capsuled with a ferrite film, which were prepared in example 2.
Figure 3:
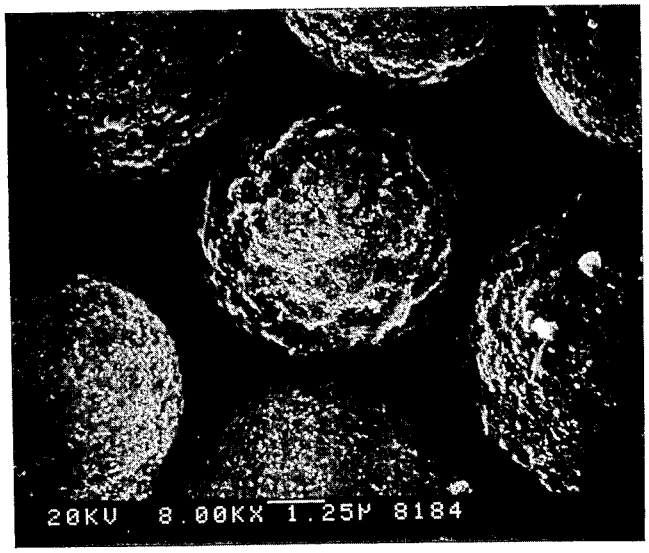
FIG. 3 is a further enlarge photograph (magnification, 8000) of the particle structure shown in FIG. 2.

FIG. 1 illustrates the outline of polystyrene not coated with a ferrite film. FIG. 2 illustrates the particles identical to those of FIG. 1 except that they are coated with a ferrite film (magnification of 3030 for FIGS. 1 and 2). FIG. 3 microscopically illustrates further enlarged particles in FIG. 2 with a magnification of 8000. In this photograph, it is apparent that the polystyrene particles are satisfactorily capsuled with a ferrite film.

EXAMPLE 3

0.9 l of deionized water was poured into a reactor vessel.

Hundred g of deionized water where ten g of six m polystyrene particles (Fine Pearl 300F manufactured by Sumitomo Chemical Co., Ltd.) having been dispersed was supplied to the reactor vessel, whereby oxygen in the solution was removed with $N_2$ gas. After thorough deoxidization, the pH value was adjusted to 6.9 by aqueous ammonia. Then, the reactor vessel was heated to 70 ° C., thereby a 100 cc ferrous ion solution containing 10 g of $FeCl_2$, 2 g of $NiCl_2$ and deionized water and a solution prepared by dissolving 20 g of sodium nitrite in one l of deionized water already deoxidized were supplied to the reactor vessel at a rate of five cc/min. The pH value was maintained constant during this course. An oxidation-reduction potential was kept −470 mV as generally described in Example 1 and $NiCl_2$ did not effect on the oxidation-reduction potentail. After approx. 20 minutes had passed, polystyrene particles encapsulated with Ni-ferrite were formed. Virtually no Ni-ferrite particles as by-products were formed. The Ni-ferrite plated polystyrene particles were filtered out and rinsed with water. The color of obtained Ni-ferrite plated polystyrene particles was brown.

By selecting various resinous materials for seed particles, the products obtained in the examples 2 and 3 may be applied to various fields such as magnetic toners, magnetic display, cosmetics, powder paints, charge-preventive fillers, magnetic printing materials and the like.

EXAMPLE 4

0.9 l of deionized water was poured into a reactor vessel.

Hundred gram of deionized water where 30 g of glass cut fibers (manufactured by Fuji Fiber Glass: diameter, 15μ; length, 3 mm) having been dispersed was supplied to the reactor vessel, whereby oxygen in the solution was removed with $N_2$ gas. After thorough deoxidization, the pH value was adjusted to 6.9 by aqueous ammonia. Then, the reactor vessel was heated to 70° C., thereby the ferrous ion solution as prepared in Example 1 and a solution prepared by dissolving 20 g of sodium nitrite in one l of deionized water already deoxidized were supplied to the reactor vessel at a rate of five cc/min. A pH value was maintained constant during this course. An oxidation-redution potential was maintained at about −470 mV. After approx. 20 minutes has passed, glass fibers coated with magnetite were prepared. Virtually no magnetite particles as by-products were formed. The magnetite plated glass fibers were filtered out and rinsed with water. The color of obtained magnetite plated glass fibers was silver gray.

The magnetite plated glass fiber can be widely used for various purposes such as for charge-preventive fillers or improvement of dispersibility of glass fibers.

EXAMPLE 5

Figure 4:
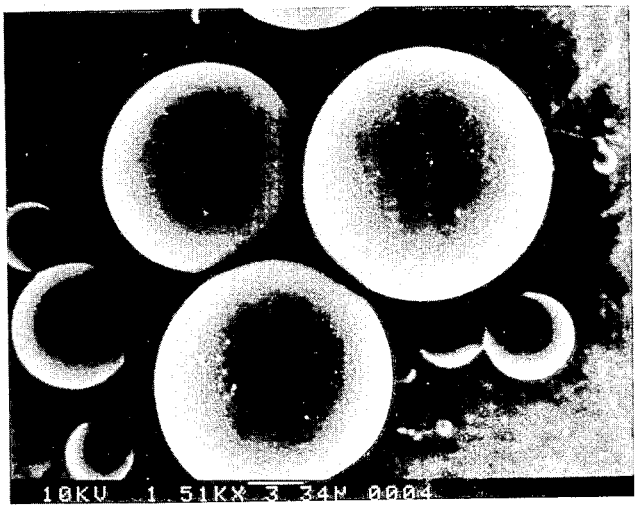
FIG. 4 is a photograph of an electron microscope of the particles before coating in Example 5.
Figure 5:
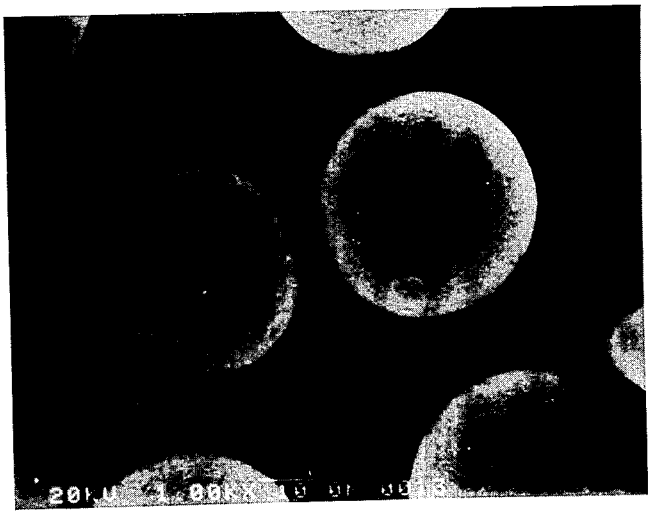
FIG. 5 is a photograph of an electron microscope of the ferrite plated particles in Example 5.

A reation vessel was charged with 100 g of a suspension particle solution (solid content of 20) prepared by a suspension polymerization having an average particle size of 30 micrometer and deoxidized by nitrogen gas. After deoxidizing, 20 g of ammonium acetate was dissolved in it and its pH was adjusted to 7.3 with heating the content of the vessel to 70° C. To the reaction vessel was added dropwise at a rate of 5 cc/min a ferrous ion solution containing 100 g of $FeCl_2$ and 200 cc of deoxidized water, and another solution containing 20 g of sadium nitrite and 200 cc of deoxidized water, while a pH of the solution being kept constant. As an oxidation-reduction potential was separately determined to find −510 mV, the addition rate of the ferrous ion solution was adjusted sufficient to maintain around −510 mV. After about 40 minutes, suspension particles which were coated with magnetite were obtained. Few magnetite particles were by-producted. After aging for 10 minutes, the partiles were separated by filtration and rinsed with water. The resultant black magnetite plated particles have no signs of peeling of magnetite after drying. The particle had a specific gravity of about 2.3 g/cm$^3$. FIG. 4 shows a photograph of a electron microscope of the particles before coating and FIG. 5 shows a photograph of an electron microscope of the ferrite plated particles.

COMPARATIVE EXAMPLE 1

Figure 6:
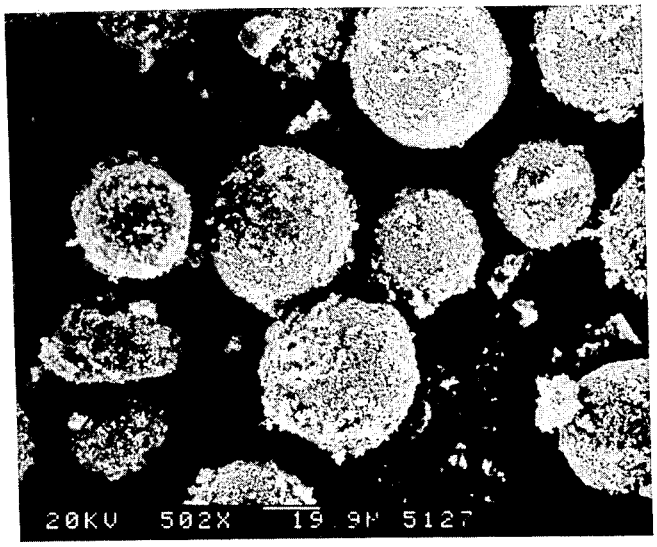
FIG. 6 is a photograph of an electron microscope of the obtained particles in Comparative Example 1.

A reaction vessel was charged with 100 g of a suspension particle solution (solid content of 20 g) prepared by a suspension polymerization having an average particle size of 30 micrometer and deoxidized by nitrogen gas. After deoxidizing, 20 g of ammonium acetate was dissolved in it and its pH was adjusted to 7.3 with aqueous ammonia while heating the content of the vessel to 70° C. To the reaction vessel was added a ferrous ion solution containing 100 g of $FeCl_2$ and 200 cc of deoxidized water. A sodium nitrite solution prepared in Example was added dropwise at a rate of 5 cc/min, while a pH of the solution being kept constant. After about 40 minutes, the reaction was terminated and a small amount of sample was taken from it to observe by a microscope. Many by-products were observed. After aging for 10 minutes, the particles were separated by filtration and rinsed with water. The resultant particles have signs of peeling of magnetite after drying. The by-products and peeled magnetite were removed by a #500 serve and had a specific gravity of about 1.5 g/cm$^3$. FIG. 6 shows a photograph of an electron microscope of the obtained particles.

EXAMPLE 6

Figure 7:
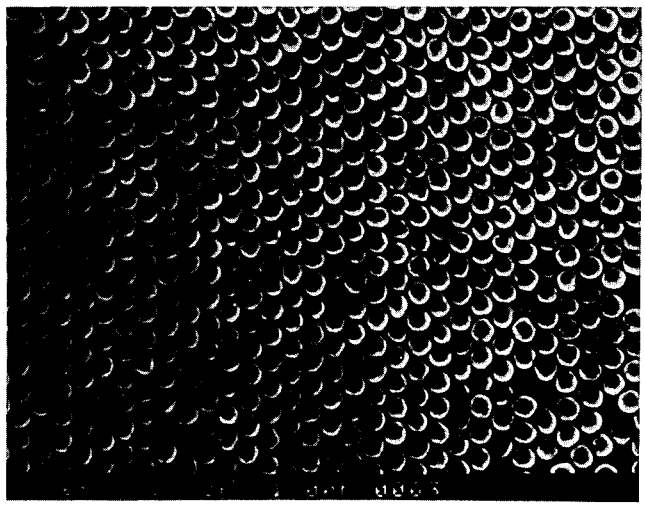
FIG. 7 is a photograph of an electron microscope of the particles before coating.
Figure 8:
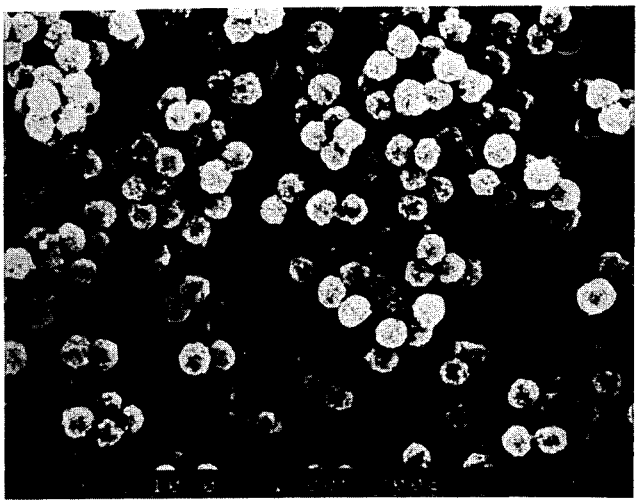
FIG. 8 is a photograph of an electron microscope of the ferrite plated particles.
Figures 9A, 9B, 9C:
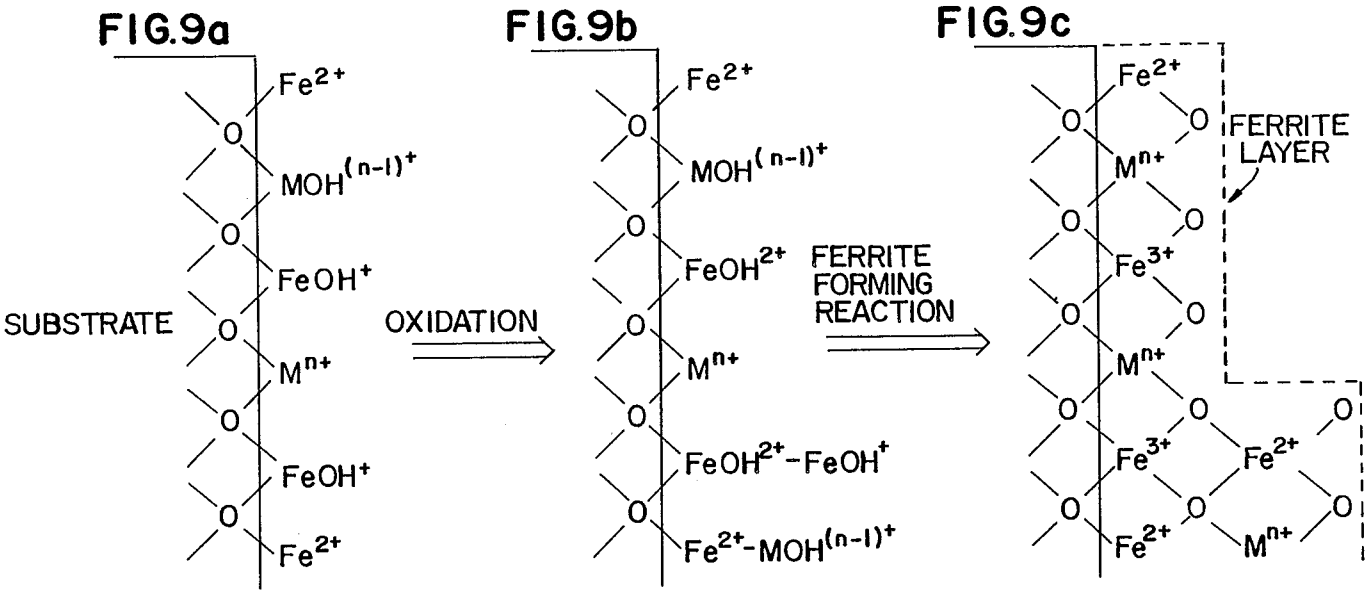
FIGS. 9(*a*) through (*c*) schematically show the method of forming a ferrite film mentioned in Japanese Laid-open Patent Application No. 111929-1984.

A reaction vessel was charged with 100 g of a suspension particle solution (solid content of 10 g) prepared by a soap-free polymerization having an average particle size of 0.3 micrometer and deoxidized by nitrogen gas. After deoxidizing, 20 g of ammonium acetate was dissolved in it and its pH was adjusted to 7.0 with aqueous ammonia while heating the content of the vessel to 70° C. To the reaction vessel was added dropwise at a rate of 4 cc/min a ferrous ion solution containing 25 g of $FeCl_2$ and 100 cc of deoxidized water, and another solution containing 20 g of sadium nitrite and 200 cc of deoxidized water, while a pH of the solution being kept constant. As an oxidation-reduction potential was separately determined to find −480 mV, the addition rate of the ferrous ion solution was adjusted sufficient to maintain around −480 mV. After about 25 minutes, suspension particles which were coated with magnetite were obtained. Few magnetite particles were by-producted. After aging for 10 minutes, the particles were separated by filtration and rinsed with water. The resultant black magnetite plated particles have magnetism. FIG. 7 shows a photograph of an electron microscope of the particles before coating and FIG. 8 shows a photograph of an elecrton microscope of the ferrite plated particles.

COMPARATIVE EXAMPLE 2

A reaction vessel was charged with 100 g of suspension particle solution of Example 6 and deoxidized by nitrogen gas. After deoxidizing, 10 g of ammonium acetate was dissolved in it and the ferrous ion solution of Example 6 was then added. Its pH was adjusted to 7.3 with aqueous ammonia and heated to 70° C. To the reaction vessel was added dropwise at a rate of 4 cc/min the sodium nitrite solution of Example 6, while a pH of the solution being kept constant. After about 25 minutes, the reaction was terminated. After aging for 10 minutes, the particles were separated by filtration and rinsed with water. The resultant particles have magnetism, but its color was brown.

What is claimed is:

1. A method of forming a ferrite film on particulate or fibrous substrate or combination of particulates and fibrous substrates by adding an oxidizer solution and a ferrous ion solution to a deoxidized solution containing particulate substrate fibrous substrates and mixture of particulate and fibrous substrates to form a thin ferrite film on the said substrates, wherein the added amount of the ferrous ion solution is controlled such that an oxidation-reduction potential of the deoxidized solution keeps approximately a center point between the oxidation side and the reduction side, when a pH value of the deoxidized solution is adjusted to a constant value between pH 6 and 10.

2. A method as claimed in claim 1, wherein said deionized solution contains at least one ion species selected from $Zn^{2+}$, $Co^{2+}$, $Co^{3+}$, $Ni^{2+}$, $Mn^{2+}$, $Mn^{3+}$, $Fe^{3+}$, $Cu^{2+}$, $V^{3+}$, $V^{4+}$, $V^{5+}$, $Sb^{5+}$, $Li^{+}$, $Mo^{4+}$, $No^{5+}$, $Ti^{4+}$, $Mg^{2+}$, $Al^{3+}$, $Si^{4+}$, $Cr^{3+}$, $Sn^{2+}$, $Sn^{4+}$, $Ca^{2+}$, $Cd^{2+}$ and $In^{3+}$.

3. A method as claimed in claim 1, wherein said ferrous ion solution contains ferrous chloride, ferrous sulfate or ferrous acetate.

4. A method as claimed in claim 1, wherein said particles have a mean diameter of less than 100$\mu$.

5. A method as claimed in claim 1, wherein said particles comprises resin, organic pigment, metal oxide or ceramic.

6. A method as claimed in claim 1, wherein said fibrous substrate has a diameter of less than 100$\mu$.

7. A method as claimed in claim 1, wherein said fibrous substrate is natural fiber, synthetic fiber or inorganic fiber.

8. A method as claimed in claim 1, wherein said oxidizer is nitrite.

* * * * *